US012377363B1

(12) United States Patent
Li

(10) Patent No.: US 12,377,363 B1
(45) Date of Patent: Aug. 5, 2025

(54) MAGNETIC BUILDING BLOCK

(71) Applicant: Mianli Li, Guangdong (CN)

(72) Inventor: Mianli Li, Guangdong (CN)

( * ) Notice: Subject to any disclaimer, the term of this patent is extended or adjusted under 35 U.S.C. 154(b) by 0 days.

(21) Appl. No.: 19/196,064

(22) Filed: May 1, 2025

(51) Int. Cl.
*A63H 33/04* (2006.01)

(52) U.S. Cl.
CPC ..... *A63H 33/046* (2013.01)

(58) Field of Classification Search
CPC ..... A63H 33/04; A63H 33/046; A63H 33/10
USPC ..... 446/92
See application file for complete search history.

(56) References Cited

U.S. PATENT DOCUMENTS 6,024,626 A * 2/2000 Mendelsohn ..... A63H 33/046 446/124
8,850,683 B2 * 10/2014 Haughey ..... A63H 33/046 446/124
11,207,609 B2 * 12/2021 Rosen ..... A63H 33/046
11,224,821 B2 * 1/2022 Rosen ..... H01F 7/0221
11,406,909 B2 * 8/2022 Zhang ..... A63H 33/26
11,458,410 B2 * 10/2022 Xu ..... A63H 33/046
11,766,622 B1 * 9/2023 Chen ..... A63H 33/046 446/92
12,151,182 B2 * 11/2024 Chen ..... A63H 33/046
12,257,526 B2 * 3/2025 Hsu ..... A63H 33/046
2012/0309259 A1 * 12/2012 Mak ..... A63H 33/046 446/92
2015/0065007 A1 * 3/2015 Klepper ..... A63H 33/046 446/92
2015/0258462 A1 * 9/2015 Wei ..... A63H 33/06 446/92

* cited by examiner

*Primary Examiner* — Kurt Fernstrom
(74) *Attorney, Agent, or Firm* — Hawaii Patent Services; Nathaniel K. Fedde; Kenton N. Fedde

(57) ABSTRACT

Disclosed is a magnetic building block, including a main housing, a top cover, a bottom cover, and magnets. The main housing is cuboid-shaped, the main housing is provided with a cavity, and an upper opening and a lower opening are formed on a pair of opposite faces of the main housing. The top cover is detachably connected to the upper opening, the bottom cover is detachably connected to the lower opening, and a mounting groove is formed on either of the top cover and the bottom cover. The magnet is arranged inside the mounting groove. Structural design of the main housing of the magnetic building block is simplified, the top cover and the bottom cover are detachably connected to the main housing in an inserted manner, and the magnets are uniformly arranged at the four right-angle corners of the top cover and the bottom cover.

10 Claims, 2 Drawing Sheets

MAGNETIC BUILDING BLOCK

TECHNICAL FIELD

The present disclosure relates to the technical field of building blocks, and in particular to a magnetic building block with a novel structure.

BACKGROUND

Early building blocks were primarily made of wood or plastic and were combined through simple splicing methods, resulting in a relatively monotonous play experience. With the development of magnetic material technology, magnetic building blocks have gradually emerged, and adsorption properties of magnets make splicing of building blocks more convenient and diverse. Structural complexity of small-sized magnetic building blocks increases manufacturing costs and compromises product quality. Generally, a magnetic building block is provided with a magnet embedded in a plastic housing. Since the plastic housing and the magnet are made of different materials, ways of assembling them together significantly affects manufacturing efficiency.

SUMMARY

In order to overcome the defects in the prior art, the present disclosure provides a magnetic building block, with an aim to solve the technical problem of the prior art that structural complexity of a magnetic building block compromises production efficiency.

To achieve the above objective, the present disclosure adopts the following technical solution:

- a magnetic building block is provided in an example of the present disclosure, including: a main housing, a top cover, a bottom cover, and magnets;
- the main housing is cuboid-shaped, the main housing is provided with a cavity, and an upper opening and a lower opening are formed on a pair of opposite faces of the main housing; and
- the top cover is detachably connected to the upper opening, the bottom cover is detachably connected to the lower opening, and a mounting groove is formed on either of the top cover and the bottom cover; the magnet is arranged inside the mounting groove.

The top cover and the bottom cover are rectangular cover plates, a side plate is arranged at a position near each of four right-angle corners of a face of the rectangular cover plate, and the mounting grooves are recessed on the side plates, and the magnet is arranged inside each of the mounting grooves.

The top cover and the bottom cover are further provided with plug-in columns, plug-in interfaces are arranged inside the main housing, and the plug-in columns are inserted into the plug-in interfaces.

The number of the plug-in columns is four, the four plug-in columns are arranged at middles of one rectangular edge of the rectangular cover plate, and the plug-in columns protrude vertically from the face of the rectangular cover plate.

A reinforcing rib is further arranged on an inner face of the rectangular cover plate.

The reinforcing rib is formed by rib strips protruding from the inner face of the rectangular cover plate, and both ends of the rib strips are connected to the side plates at diagonal positions.

The main housing includes an enclosing side plate, a supporting plate is connected to the enclosing side plate from inside, and edges of the supporting plate extend to inner walls of the enclosing side plate.

The supporting plate is further provided with hollow holes.

At least an upper columnar body and a lower columnar body extend vertically from an upper face and a lower face of the supporting plate, and both the upper columnar body and the lower columnar body are provided with the plug-in interfaces.

The supporting plate is arranged at a middle of the enclosing side plate, and the supporting plate is parallel to the top cover.

Outer walls of the upper columnar body and the lower columnar body are connected to the inner walls of the enclosing side plate.

The main housing is of an integrated structure.

Both the top cover and the bottom cover are of an integrated structure.

In the present disclosure, structural design of the main housing of the magnetic building block is simplified, the top cover and the bottom cover are detachably connected to the main housing in an inserted manner, and the magnets are uniformly arranged at the four right-angle corners of the top cover and the bottom cover, which simplifies the structure of each component, and reduces manufacturing complexity. Additionally, the magnets are arranged on the top cover and the bottom cover, which simplifies assembly and enhances production efficiency.

The above description is merely a summary of the technical solution of the present disclosure. In order to have a clearer understanding of the technical means of the present disclosure, the content of the specification may be referred to for implementation. To make the above and other objectives, features and advantages of the present disclosure apparent and understandable, the following preferred examples are detailed as follows.

REFERENCE NUMERALS IN THE FIGURES

Figure 1:
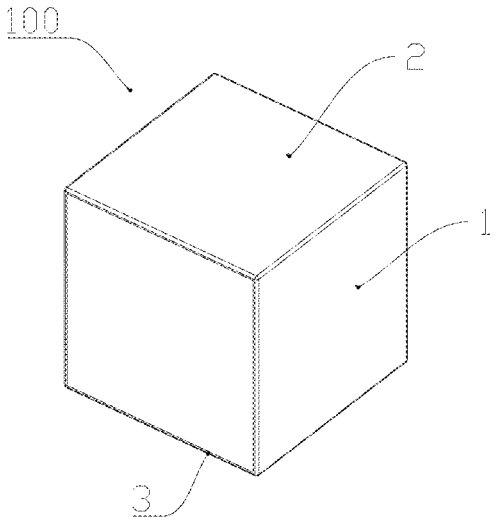
FIG. 1 is a schematic diagram of an overall structure of a magnetic building block according to an example of the present disclosure.

100-magnetic building block, 1-main housing, 11-enclosing side plate, 12-supporting plate, 121-hollow hole, 13-upper columnar body, 131-plug-in interface, 14-lower columnar body, 2-top cover, 21-rectangular cover plate, 22-mounting groove, 23-side plate, 24-plug-in column, 25-reinforcing rib, 3-bottom cover, and 4-magnet.

DETAILED DESCRIPTIONS OF THE EMBODIMENTS

In order to make objectives, technical solutions and advantages of the present disclosure clearer, the present disclosure will be described in further detail below with reference to the accompanying drawings and specific embodiments.

The technical solutions in the examples of the present disclosure will be clearly and completely described below in combination with the accompanying drawings in the examples of the present disclosure. Apparently, the examples described are merely some rather than all of the examples of the present disclosure. Based on the examples of the present disclosure, all other examples obtained by those skilled in the art without making creative efforts shall fall within the protection scope of the present disclosure.

In the description of the present disclosure, it is to be understood that the terms "central", "longitudinal", "transverse", "length", "width", "thickness", "upper", "lower", "front", "rear", "left", "right", "vertical", "horizontal", "top", "bottom", "inner", "outer", "clockwise", "counterclockwise", etc. indicate azimuthal or positional relations based on those shown in the accompanying drawings only for ease of description of the present disclosure and for simplicity of description, and are not intended to indicate or imply that the referenced device or element must have a particular orientation and be constructed and operative in a particular orientation, and thus may not be interpreted as a limitation on the present disclosure.

Furthermore, the terms "first" and "second" are merely for the purpose of description, and cannot be construed as indicating or implying relative importance or implicitly specifying the number of technical features indicated. Thus, a feature defined with "first" and "second" may explicitly or implicitly include one or more of the features. In the description of the present disclosure, "a plurality of" means two or more, unless expressly specified otherwise.

In the present disclosure, unless otherwise explicitly specified and defined, the terms "mounting", "connecting", "connection", "fixing", etc. should be understood in a broad sense, for example, they may be a fixed connection, a detachable connection, or an integrated connection; may be a mechanical connection, or an electrical connection; may be a direct connection, or an indirect connection via an intermediate medium; and may be communication inside two elements, or an interactive relation between two elements. For those skilled in the art, the specific meanings of the terms described above in the present disclosure may be interpreted according to specific circumstances.

In the present disclosure, unless otherwise expressly stated and defined, a first feature being "above" or "below" a second feature may include the first and second features being in direct contact or that the first and second features being not in direct contact but being in contact by means of additional features between the first and second features. In addition, the first feature being "over", "above" and "on the top of" the second feature includes that the first feature is over and above the second feature, or simply means that the level of the first feature is higher than that of the second feature. The first feature being "under", "below" and "at the bottom of" the second feature includes that the first feature is under and below the second feature, or simply means that the level of the first feature is lower than that of the second feature.

In the description of the present description, the description of reference terms such as "one embodiment", "some embodiments", "example", "specific example" or "some examples" means that specific features, structures, materials or characteristics described in combination with the embodiment or example are included in at least one embodiment or example of the present disclosure. In the present description, the schematic description of the above terms should not be construed as necessarily referring to the same embodiment or example. Moreover, the specific features, structures, materials or characteristics described may be combined in a suitable manner in any one or more embodiments or examples.

Early building blocks were primarily made of wood or plastic and were combined through simple splicing methods, resulting in a relatively monotonous play experience. With the development of magnetic material technology, magnetic building blocks have gradually emerged, and adsorption properties of magnets make splicing of building blocks more convenient and diverse. Structural complexity of small-sized magnetic building blocks increases manufacturing costs and compromises product quality. Generally, a magnetic building block is provided with a magnet embedded in a plastic housing. Since the plastic housing and the magnet are made of different materials, ways of assembling them together significantly affects manufacturing efficiency. In order to solve the above problems, a magnetic building block 100 with a simple structure is disclosed in this example.

With reference to FIGS. 1-6, a magnetic building block 100 is disclosed in this example, including: a main housing 1, a top cover 2, a bottom cover 3, and magnets 4;

the main housing 1 is cuboid-shaped, the main housing 1 is provided with a cavity, and an upper opening 101 and a lower opening 102 are formed on a pair of opposite faces of the main housing 1; and the top cover 2 is detachably connected to the upper opening 101, the bottom cover 3 is detachably connected to the lower opening 102, and a mounting groove 22 is formed on either of the top cover 2 and the bottom cover 3; and the magnet 4 is arranged inside the mounting groove 22.

In this example, the magnets 4 of the magnetic building block 100 are mounted on the top cover 2 and the bottom cover 3, and during assembly, the magnets 4 are first fixed in the mounting grooves 22, and then assembled inside the main housing 1 together with the top cover 2 or the bottom cover 3, with simple, fast, and efficient assembly achieved.

Figure 2:
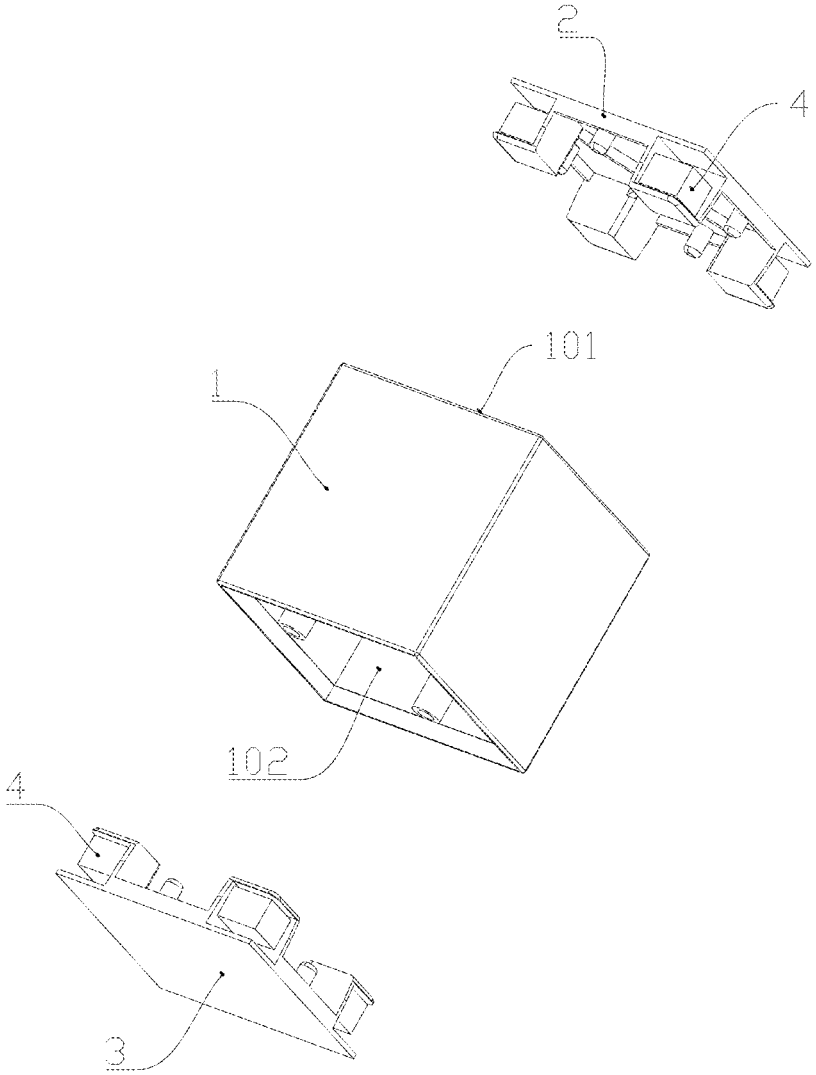
FIG. 2 is an exploded view of a magnetic building block according to an example of the present disclosure.
Figure 3:
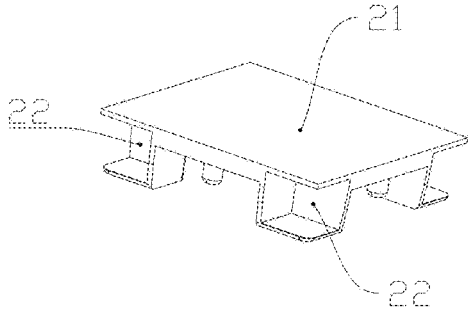
FIGS. 3-5 are schematic structural diagrams of different views of a top cover of a magnetic building block according to an example of the present disclosure.
Figure 4:
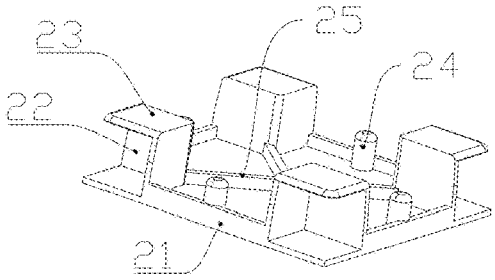

With reference to FIG. 2, the top cover 2 and the bottom cover 3 are structurally identical, and the top cover 2 and bottom cover 3 are symmetrically arranged on the main housing 1. Taking the top cover 2 as an example to describe the structure, the top cover 2 includes a rectangular cover plate 21, a side plate 23 is arranged at a position near each of four right-angle corners of a face of the rectangular cover plate 21, and the mounting grooves 22 are recessed on the side plates 23, and the magnet 4 is arranged inside each of the mounting grooves 22. The side plates 23 with the recessed mounting grooves 22 are arranged at positions near the four right-angle corners of the rectangular cover plate 21, the side plates 23 protruding from the rectangular cover plate 21 are used for positioning during assembly, and the four protruding side plates 23 abut against four edges of the main housing 1 during assembly, which facilitates quick alignment and assembly.

It is to be understood that in other examples, the magnets 4 may be uniformly arranged based on the number and shape thereof, which is also a feasible solution.

In this example, the top cover 2 is further provided with plug-in columns 24, plug-in interfaces 131 are arranged inside the main housing 1, and the plug-in columns 24 are inserted into the plug-in interfaces 131. Notably, the numbers and positions of the plug-in columns 24 and the plug-in interfaces 131 correspondingly match. Additionally, the positions of the plug-in columns 24 and the plug-in interfaces 131 may be interchanged between the top cover 2 and the main housing 1.

It is to be understood that in other examples, the top cover 2 and the main housing 1 are alternatively connected through other snap-fit structures, such as a structure of combining a snap-fit member and a snap-fit slot, or a structure of connection through screws and threaded holes.

Figure 5:
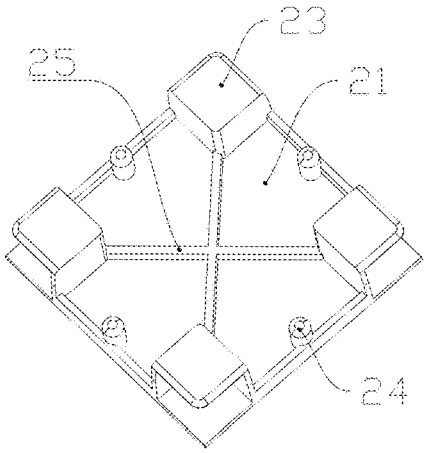
Figure 6:
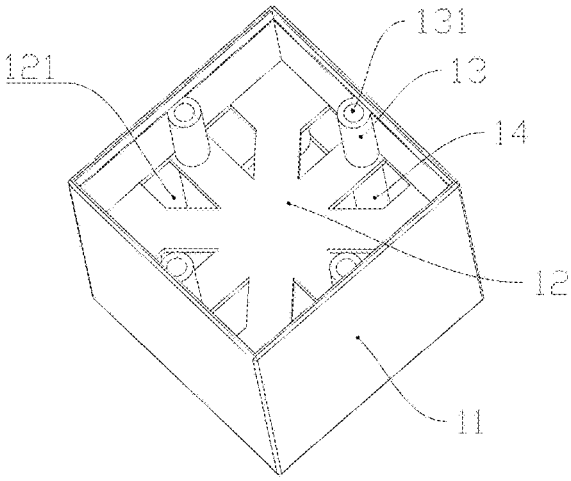
FIG. 6 is a schematic structural diagram of a main housing of a magnetic building block according to an example of the present disclosure.

As shown in FIG. 5, in this example, the number of the plug-in columns 24 is four, the four plug-in columns 24 are arranged at middles of one rectangular edge of the rectangular cover plate 21, and the plug-in columns 24 protrude vertically from the face of the rectangular cover plate 21.

To enhance the structural strength of the top cover 2, a reinforcing rib 25 is further arranged on an inner face of the rectangular cover plate 21.

In this example, the reinforcing rib 25 is formed by rib strips protruding from the inner face of the rectangular cover plate 21, and both ends of the rib strips are connected to the side plates 23 at diagonal positions, which ultimately form the cross-shaped reinforcing rib 25.

With reference to FIG. 6 again, the main housing 1 includes an enclosing side plate 11, a supporting plate 12 is connected to the enclosing side plate 11 from inside, and edges of the supporting plate 12 extend to inner walls of the enclosing side plate 11. The enclosing side plate 11 is of a cuboid-shaped structure formed by four rectangular side plates, and the top cover 2 and the bottom cover 3 together form a cuboid-shaped building block.

To reduce material consumption and weight of the building block, the supporting plate 12 is further provided with hollow holes 121.

At least an upper columnar body 13 and a lower columnar body 14 extend vertically from an upper face and a lower face of the supporting plate 12, and both the upper columnar body 13 and the lower columnar body 14 are provided with the plug-in interfaces 131. Similarly, the upper columnar body 13 and the lower columnar body 14 extend from central positions of the edges of the supporting plate 12 and are fitted with inner walls of the enclosing side plate 11.

In this example, the supporting plate 12 is arranged at a middle of the enclosing side plate 11, and the supporting plate 12 is parallel to the top cover 2. The supporting plate 12 not only enhances structural rigidity of the main housing 1, but also provides a connection structure for assembly of the top cover 2 and the bottom cover 3.

Outer walls of the upper columnar body 13 and the lower columnar body 14 are connected to the inner walls of the enclosing side plate 11. The design simplifies processing and enhances reliability of connection of the upper columnar body 13 and the lower columnar body 14 with the enclosing side plate 11.

The main housing 1 is of an integrated structure, and both the top cover 2 and the bottom cover 3 are of an integrated structure, which enables efficient injection molding.

The structure of only the top cover 2 is described above, and the bottom cover 3 and the top cover 2 are structurally identical and are symmetrically assembled on the main housing 1, and therefore the connection relationship between the bottom cover 3 and the main housing 1 is identical to the connection relationship between the top cover 2 and the main housing 1, such that details are not described herein.

In this example, structural design of the main housing of the magnetic building block is simplified, the top cover and the bottom cover are detachably connected to the main housing in an inserted manner, and the magnets are uniformly arranged at the four right-angle corners of the top cover and the bottom cover, which simplifies the structure of each component, and reduces manufacturing complexity. Additionally, the magnets are arranged on the top cover and the bottom cover, which simplifies assembly and enhances production efficiency.

The above examples are only intended to further illustrate the technical content of the present disclosure and facilitate understanding by the readers, but it does not mean that the embodiments of the present disclosure are only limited thereto. Any technical extension or recreation made based on the present disclosure falls within the scope of protection of the present disclosure. The scope of protection of the present disclosure shall be governed by the appended claims.

What is claimed is:

1. A magnetic building block, comprising a main housing, a top cover, a bottom cover, and magnets;

the main housing is cuboid-shaped, the main housing is provided with a cavity, and an upper opening and a lower opening are formed on a pair of opposite faces of the main housing;

the top cover is detachably connected to the upper opening, the bottom cover is detachably connected to the lower opening, and a mounting groove is formed on either of the top cover and the bottom cover; the magnet is arranged inside the mounting groove;

the top cover and the bottom cover are rectangular cover plates, a side plate is arranged at a position near each of four right-angle corners of a face of the rectangular cover plate, and the mounting grooves are recessed on the side plates, and the magnet is arranged inside each of the mounting grooves;

the top cover and the bottom cover are further provided with plug-in columns, plug-in interfaces are arranged inside the main housing, and the plug-in columns are inserted into the plug-in interfaces; and the number of the plug-in columns is four, the four plug-in columns are arranged at middles of one rectangular edge of the rectangular cover plate, and the plug-in columns protrude vertically from the face of the rectangular cover plate.

2. The magnetic building block according to claim 1, wherein a reinforcing rib is further arranged on an inner face of the rectangular cover plate.

3. The magnetic building block according to claim 2, wherein the reinforcing rib is formed by rib strips protruding from the inner face of the rectangular cover plate, and both ends of the rib strips are connected to the side plates at diagonal positions.

4. The magnetic building block according to claim 2, wherein the main housing comprises an enclosing side plate, a supporting plate is connected to the enclosing side plate from inside, and edges of the supporting plate extend to inner walls of the enclosing side plate.

5. The magnetic building block according to claim 4, wherein the supporting plate is further provided with hollow holes.

6. The magnetic building block according to claim 5, wherein at least an upper columnar body and a lower columnar body extend vertically from an upper face and a lower face of the supporting plate, and both the upper columnar body and the lower columnar body are provided with the plug-in interfaces.

7. The magnetic building block according to claim 6, wherein the supporting plate is arranged at a middle of the enclosing side plate, and the supporting plate is parallel to the top cover.

8. The magnetic building block according to claim 6, wherein outer walls of the upper columnar body and the lower columnar body are connected to the inner walls of the enclosing side plate.

9. The magnetic building block according to claim 8, wherein the main housing is of an integrated structure.

10. The magnetic building block according to claim 8, wherein both the top cover and the bottom cover are of an integrated structure.

* * * * *